United States Patent [19]

Kuss

[11] Patent Number: 4,610,417

[45] Date of Patent: Sep. 9, 1986

[54] FOLDING MUSIC HOLDER

[76] Inventor: Dietmar Kuss, Scapinellistrasse 13, 8000 Munich 60, Fed. Rep. of Germany

[21] Appl. No.: 613,262

[22] Filed: May 24, 1984

[30] Foreign Application Priority Data

May 26, 1983 [DE] Fed. Rep. of Germany ..... 3319166
Feb. 3, 1984 [DE] Fed. Rep. of Germany ..... 3403849

[51] Int. Cl.[4] ..... A47B 97/08
[52] U.S. Cl. ..... 248/460; 248/472
[58] Field of Search ..... 248/460, 459, 441.1, 248/472, 461, 443

[56] References Cited

U.S. PATENT DOCUMENTS

| | | | |
|---|---|---|---|
| 179,134 | 6/1876 | Rand | 248/461 |
| 2,383,287 | 8/1945 | Berg | 248/460 |
| 2,481,264 | 9/1949 | Tulowiecki . | |
| 2,844,347 | 7/1958 | Henry | 248/460 |
| 3,381,928 | 5/1968 | White | 248/460 |
| 3,410,516 | 11/1968 | Criswell | 248/459 |
| 3,682,433 | 8/1972 | Petersen | 248/459 |
| 4,300,743 | 11/1981 | Morris | 248/460 X |
| 4,318,527 | 3/1982 | Smith | 248/460 X |
| 4,372,518 | 2/1983 | Biasini . | |
| 4,378,103 | 3/1983 | Portis, Jr. et al. | 248/451 X |
| 4,460,146 | 7/1984 | Raggiotti | 248/460 X |

FOREIGN PATENT DOCUMENTS

| | | | |
|---|---|---|---|
| 258807 | 12/1948 | Switzerland | 248/460 |

*Primary Examiner*—Ramon S. Britts
*Assistant Examiner*—Karen J. Chotkowski
*Attorney, Agent, or Firm*—Hill, Van Santen, Steadman & Simpson

[57] ABSTRACT

The desk of the folding music holder with a support part and a rest running approximately transversely to it consists of at least two folding hinged portions, in particular rest parts, which hang together through hinge bands. Each hinge band is preferably designed as material thin point in the area of a groove between the hinged portions. The rest or the entire desk can thus be formed as a one-piece plastic part, where the rest in the operating position provides a flush work surface.

1 Claim, 6 Drawing Figures

FIG. 2
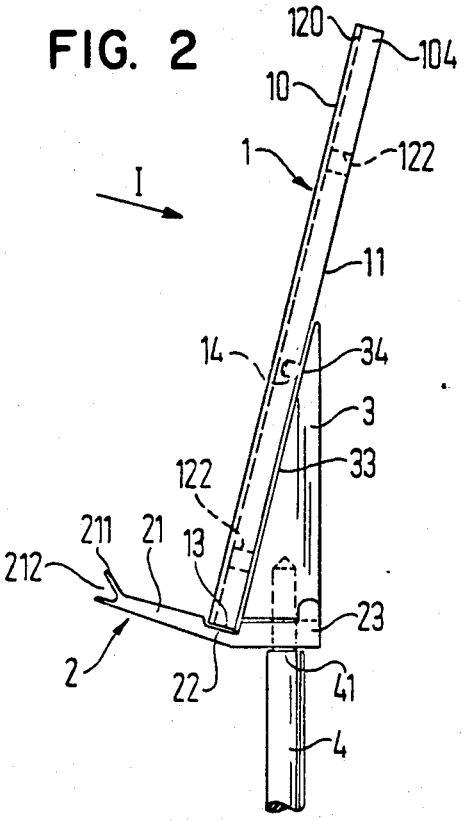
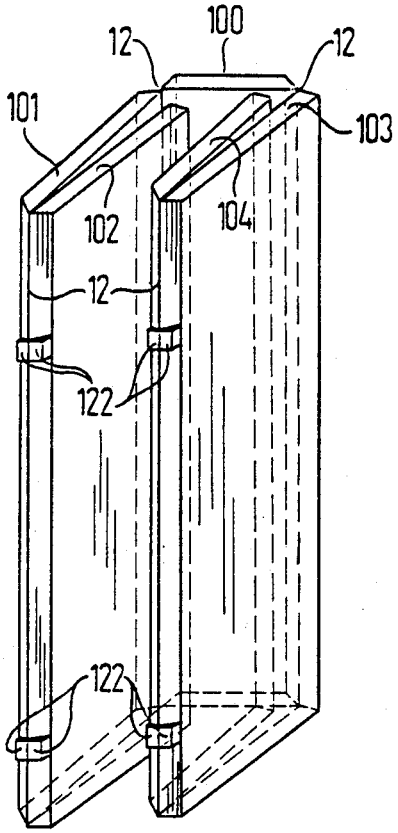
FIG. 4
FIG. 3
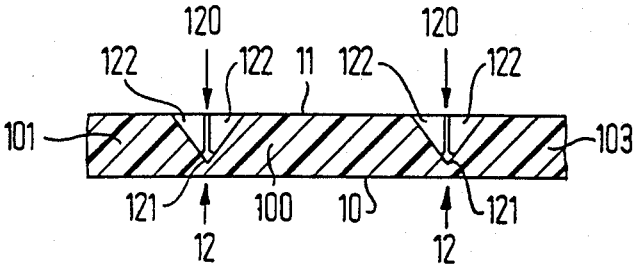

FOLDING MUSIC HOLDER

BACKGROUND OF THE INVENTION

Field of the Invention

The invention relates to a music holder having a folding desk with at least two hinged portions joined by an articulated connection, wherein the hinged portions are supported in an operating position by a carrier means and secured in this position by locking means.

A music holder with a desk having several hinged portions is described in the U.S. Pat. No. 2,481,264. In particular, the hinged portions are two rest parts and two support parts supported by an aritculated connection on the rest parts. However, the joints between these hinged portions are conventionally constructed, for example, as hinge bands, resulting in a complicated construction, at least if specific minimum requirements for durability and stability are established.

SUMMARY OF THE INVENTION

One object of the invention is therefore to simplify the construction of a folding music desk without impairing its stability and its operational security. Another object is to provide a music rest the front of which has a stiff, homogenous and flush surface, so that it can be used as a writing support for thin music scores lying on it.

According to the invention, the hinge bands between the hinged portions are thin strips of plastic; they can either be connected with the hinged portions, for example, by gluing, or form with them a single homogenous piece. The latter embodiment has the particular advantage that the entire desk can be produced by means of an appropriate mold in a single casting or injection process: the mold requires in the area of each hinge band on one side (the later rear of the desk) only a projection, e.g. in the form of a V-shaped rib. The material lying under this rib between the hinged portions can function as a hinge band because of its reduced cross section. The mold is preferably designed so that the inherently rigid hinged portions and the hinge bands in the operating position form a flush surface which can serve as a writing base.

Within the scope of the invention the rest of the desk can have two or more rest parts designed as hinged portions; the hinge band between every two of the folding rest parts can run parallel to the longitudinal or the transverse axis of the desk. It is particularly advantageous to design the rest on the one hand and a support part of the desk on the other hand as hinged portions, which are connected with each other through a hinge band running parallel to the transverse axis of the desk; as previously mentioned, here also the rest can consist of several rest elements. In this case, the rest and the support part may be foldable also around the longitudinal axis by means of at least one hinge band running parallel to the longitudinal axis of the desk, so that the desk is foldable into two different formats for transport.

In the operating position, the support part projecting at approximately a right angle from the rest assures an alignment of all rest parts.

For supporting the hinged portions in an operating position and for setting up the desk directly on a table or by means of a tripod on the floor, a carrier means is used, which is arranged on the rear of the desk, and in particular can be detached from it. It has a straight support surface for supporting the rear of the rest, which provides the rest with additional stability. It simultaneously aligns the front of the rest when the rest consists of rest parts which hang on each other by hinge bands running parallel to the transverse axis.

Preferably, the carrier means has a support bracket for the support part of the desk projecting at approximately a right angle from support surface of the carrier means; the carrier means and support brack can be designed as a single piece or be joined by an articulated connection. Locking means are provided for securing the desk in its operating position.

BRIEF DESCRIPTION OF THE DRAWINGS

FIG. 2 is a side elevation in the direction of the arrow II in FIG. 1.

FIG. 3 is an enlarged part of a section along line III—III in FIG. 1.

FIG. 4 is a perspective elevation of the rest according to FIG. 1 in partially folded condition.

DESCRIPTION OF THE PREFERRED EMBODIMENTS

Figure 1:
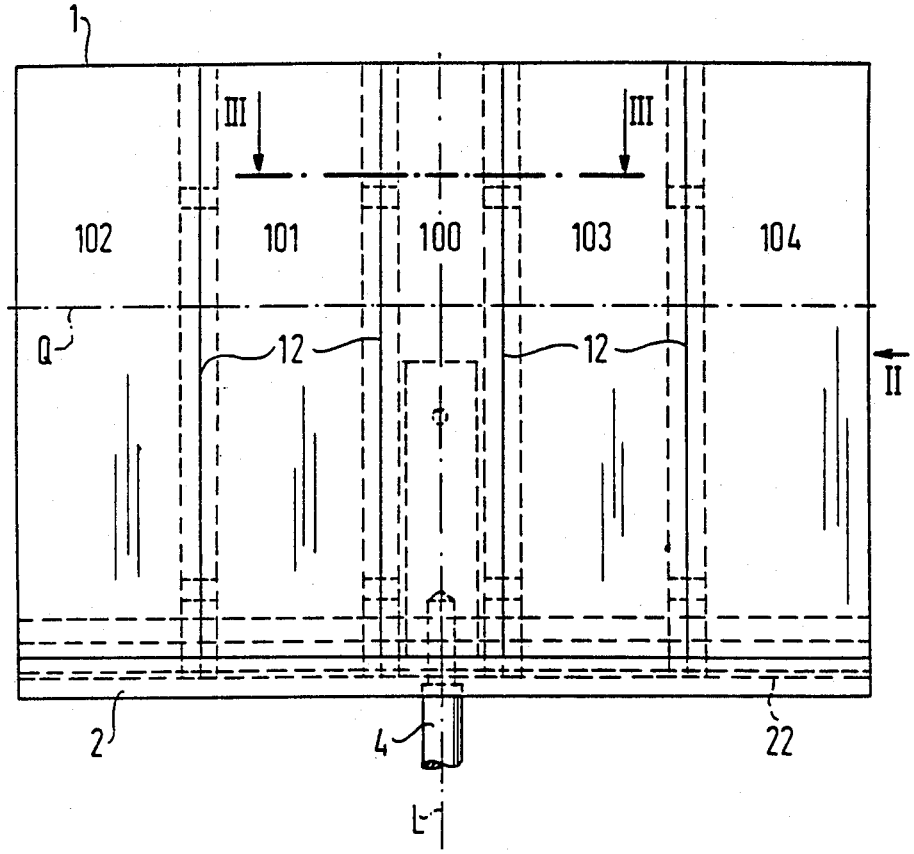
FIG. 1 is an elevation in the direction of the arrow I in FIG. 2 of a desk with a separate support part constructed in accordance with the principles of the present invention.

In the embodiment according to FIGS. 1 to 4, the music rest 1 consists of a middle rest part 100, to which on both sides two rest parts 101, 102 and 103, 104 respectively are hinged. These rest parts hang together by means of a plurality of flexible hinge bands 12 running parallel to the longitudinal axis L of the desk and form a one-piece plastic part. These hinge bands lie between the groove base 121 of V-shaped grooves 120 on the rear 11 and the front 10, the latter forming in this manner a flush and homogenous surface (FIG. 3).

As FIG. 4 shows, the rest parts can be folded against each other and in the end position these parts are located approximately parallel to each other and at a right angle to the rest part 100.

The support part 2 is one homogenous piece, preferably an injection-molded unit with a supporting leg 21, a groove 22 and a slightly angled edge element 23 located behind it. The latter has a recess for insertion of a foot 4, which in turn has a peg 41, on which the edge element 23 on the support part 2 is seated. It is held in this position by a wedge-shaped carrier 3, which is connected with the middle rest part 100 of the rest 1 and is attached with firm seat onto the end of the peg 4, so that the edge piece 23 is clamped between this carrier 3 and the support 41.

The middle rest part 100 can be solidly connected with the wedge-shaped carrier 3 or constructed in one piece with it. Preferably the rest—as shown here—is a separate part, which is inserted with its lower edge 13 into the groove 22 of the support part 2 and is then pressed against a support surface 33 of the carrier 3. In the process, an elastic connection pin 34 snaps into a corresponding recess 14 in the rest part 100. The rest parts 100 to 104 are aligned by the groove 22; the rest obtains additional stability from the fact that right-angled stops 122 are provided in the grooves 120 between the rest parts, which prevent a bending to the rear of the individual rest parts (FIG. 3).

The supporting leg 21 has an edge leg 211 bent somewhat upward which prevents the music from dropping or from being unintentionally turned over. A storage groove 212 for writing means is provided below. The edge element 23 behind the groove 22 is designed in groove shape and can also act as storage place for writing means.

Figure 5:
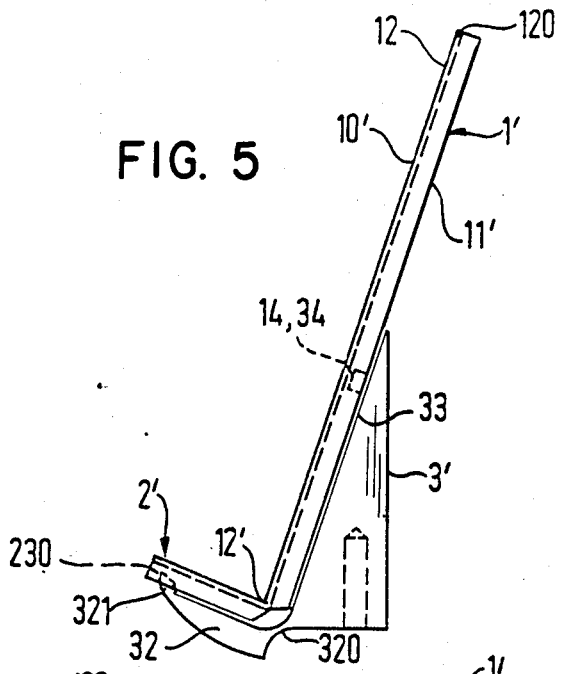
FIG. 5 is a side elevation of a second embodiment of a desk constructed in accordance with the principles of the present invention.
Figure 6:
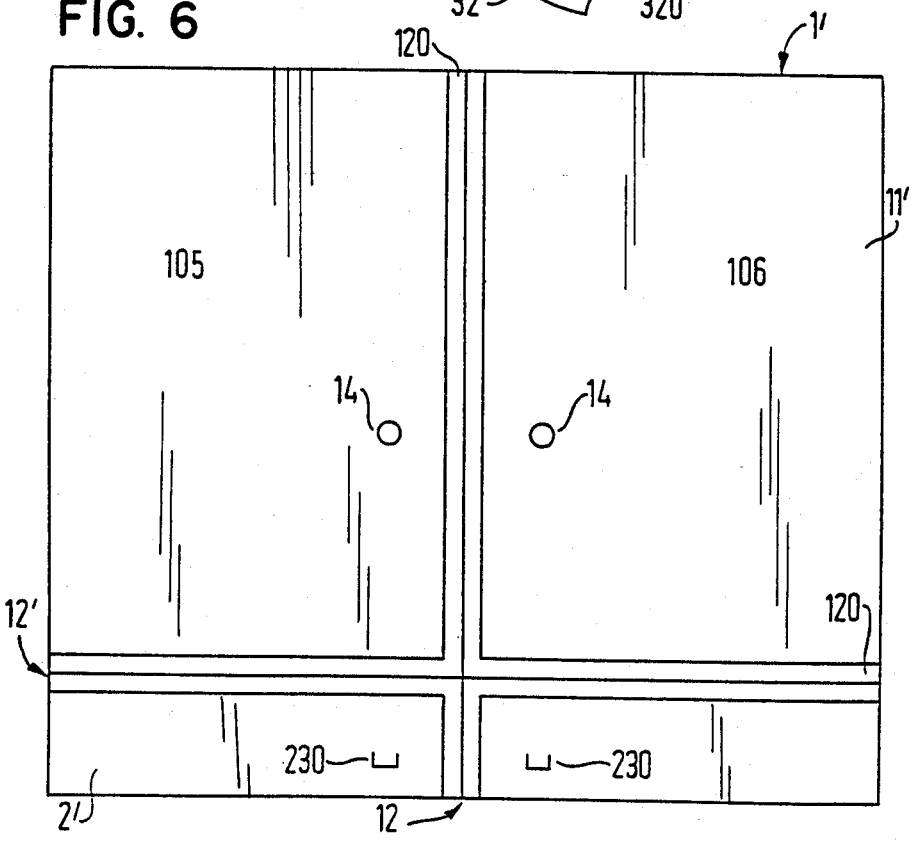
FIG. 6 is a rear elevation of the rest according to FIG. 5 before folding.

In the embodiment according to FIGS. 5 and 6, the entire desk, consisting of two parts 105 and 106 and a support part 2', is a one-piece plastic part. As can be clearly recognized particularly from FIG. 6, the unit is a rigid plastic sheet or plate which is divided into a rest 1' and a support part 2' by a groove 120 on its rear 11' running parallel to the transverse axis of the desk. An additional groove 120 running transversely to the before mentioned groove divides the support part 2' and the rest 1' into two halves. The grooves 120 are again designed as explained in detail with reference to FIG. 3, thereby defining one hinge band 12 between the rest parts 105 and 106 and one hinge band 12' between the rest 1' and the support part 2'.

For transport, the sheet shown in FIG. 6 may be folded around the hinge bands 12 or 12'.

To set up the desk, only the support part 2' has to be swung out of the level of the rest 1', as FIG. 5 shows: the hinge band 12' then effects a straight alignment of the two rest parts 105 and 106, so that they lie in one plane, although they are supported in the middle only by a carrier 3'. This carrier engages with two connecting pins 34 into two associated recesses 14 (FIG. 6) on the rear 11' of the rest 1'. On the other hand, the support part 2' rests on a support bracket 32, which is connected with carrier 3' through a joint 320, and which engages with a stop stud 321 into a recess with holding edge 230 on the bottom of the support part 2'.

Since the support part 2' seeks to spring into the natural position shown in FIG. 6, support part 2' hooks with support bracket 32 thereby operating as locking means which secure the desk in its operating position shown in FIG. 5.

To dismantle the desk it is only necessary to push the support part 2' somewhat upwards: The support bracket 32 is then released from the recess with stop edge 230, so that the rest 1' —with integrated support part—can be removed from the carrier and folded.

In the embodiment according to FIGS. 5 and 6, a carrier is used which overlaps the hinge band 12 located in the middle and is coupled on both sides of it with the desk. It is also possible, however, to manage with only one coupling point in the area of the rest and one in the support part and to place these coupling points in the area of the hinge band 12.

I claim as my invention:

1. A music holder comprising:

a folding desk having a rest having a horizontal transverse axis and a homogenous, flush surface inclined against the vertical when in an operating position, and a support part disposed parallel to the horizontal and projecting from said rest at substantially a right angle when in the operating position, said support part being hingedly connected to said rest by a hinge band running from one end of said desk to the other end parallel to the transverse axis;

said rest having at least two folding rest parts, and at least one additional hinge band connecting every two of said rest parts, said additional hinge band crossing the hinge band between said rest and said support part and extending through the support part, said rest parts, said support part, and said hinge bands forming said folding parts consisting of a one-piece plastic plate having a flush front and a rear with a groove at the position of each hinge band;

a carrier for supporting said desk in an operating position having a support surface for supporting the rear of said rest, a support bracket for supporting said support part of said desk being located at approximately a right angle to said support surface of said carrier, means for detachably connecting said support surface of said carrier to the rear of said rest, and means for detachably connecting said support part of said desk to said support bracket of said carrier; and means for connecting said carrier to a top end of a tripod.

* * * * *